US010168102B2

(12) United States Patent
Ito

(10) Patent No.: US 10,168,102 B2
(45) Date of Patent: Jan. 1, 2019

(54) PLATE TYPE HEAT EXCHANGER AND REFRIGERATION CYCLE APPARATUS HAVING THE SAME PLATE TYPE HEAT EXCHANGER

(71) Applicant: Daisuke Ito, Tokyo (JP)

(72) Inventor: Daisuke Ito, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 14/435,237

(22) PCT Filed: Oct. 16, 2012

(86) PCT No.: PCT/JP2012/076726

§ 371 (c)(1),
(2) Date: Apr. 13, 2015

(87) PCT Pub. No.: WO2014/061105

PCT Pub. Date: Apr. 24, 2014

(65) Prior Publication Data

US 2015/0260460 A1 Sep. 17, 2015

(51) Int. Cl.
*F28F 3/06* (2006.01)
*F28D 9/00* (2006.01)
(Continued)

(52) U.S. Cl.
CPC ..... *F28D 9/0093* (2013.01); *F25B 39/04* (2013.01); *F28D 9/005* (2013.01); *F28F 3/025* (2013.01);
(Continued)

(58) Field of Classification Search
CPC .... F28F 1/40; F28F 13/02; F28F 3/048; F28F 3/042; F28F 3/046; F28F 3/06; F28F 3/025; F28F 3/027; F28D 9/005
(Continued)

(56) References Cited

U.S. PATENT DOCUMENTS 2,571,631 A * 10/1951 Trumpler ..... F28F 3/027 165/166
4,434,842 A * 3/1984 Gregory ..... F28F 3/027 165/133
(Continued)

FOREIGN PATENT DOCUMENTS

CN 101162132 B 1/2012
JP 57101294 A * 6/1982 ..... F28F 3/025
(Continued)

OTHER PUBLICATIONS

Extended European Search Report dated Jul. 11, 2016 issued in corresponding EP patent application No. 12886566.4.
(Continued)

*Primary Examiner* — Leonard R Leo
(74) *Attorney, Agent, or Firm* — Posz Law Group, PLC

(57) ABSTRACT

A plate type heat exchanger is a plate type heat exchanger in which a first flow path through which a first fluid circulates and a second flow path through which a second fluid circulates are alternatively formed between a plurality of heat transfer plates, and an inner fin is disposed at least in the first flow path. Further, in the plate type heat exchanger, recessed grooves having a dimension smaller than that between fin sections of the inner fin are formed along a flow direction of the first fluid in an area of the inner fin that faces the heat transfer plate and on the heat transfer plate.

10 Claims, 9 Drawing Sheets

(51) Int. Cl.

| | |
|---|---|
| ***F25B 39/04*** | (2006.01) |
| ***F28F 9/02*** | (2006.01) |
| *F28F 3/02* | (2006.01) |
| *F28F 3/04* | (2006.01) |
| *F28D 21/00* | (2006.01) |

(52) U.S. Cl.
CPC ..... *F28F 3/06* (2013.01); *F28F 9/0265* (2013.01); *F25B 2339/047* (2013.01); *F28D 2021/007* (2013.01); *F28F 3/027* (2013.01); *F28F 3/048* (2013.01)

(58) Field of Classification Search
USPC ..... 165/133, 166, 167, 183
See application file for complete search history.

(56) References Cited

U.S. PATENT DOCUMENTS

| | | | | | |
|---|---|---|---|---|---|
| 4,653,581 | A * | 3/1987 | Yogo | F28D 9/0075 | 165/166 |
| 4,815,534 | A * | 3/1989 | Fuerschbach | F28D 9/0075 | 165/166 |
| 5,029,636 | A * | 7/1991 | Kadle | F28F 3/027 | 165/109.1 |
| 5,184,672 | A * | 2/1993 | Aoki | F28F 3/027 | 165/109.1 |
| 5,193,611 | A * | 3/1993 | Hesselgreaves | F28F 3/02 | 165/165 |
| 5,544,703 | A * | 8/1996 | Joel | F28F 3/048 | 165/166 |
| 5,836,383 | A * | 11/1998 | Zwittig | F28D 1/0375 | 165/167 |
| 6,695,044 | B1 * | 2/2004 | Symonds | B01J 19/249 | 165/166 |
| 6,925,711 | B2 * | 8/2005 | Kilmer | F28F 1/10 | 29/5 |
| 7,032,654 | B2 * | 4/2006 | Wand | F28F 3/027 | 165/133 |
| 7,044,210 | B2 * | 5/2006 | Usui | F28F 3/025 | 165/133 |
| 7,740,058 | B2 | 6/2010 | Koepke et al. | | |
| 8,561,451 | B2 * | 10/2013 | Opferkuch | F28F 3/027 | 29/890.053 |

FOREIGN PATENT DOCUMENTS

| | | | | |
|---|---|---|---|---|
| JP | 57105690 | A * | 7/1982 | F28F 3/025 |
| JP | 58-148480 | U | 10/1983 | |
| JP | S64-041777 | A | 2/1989 | |
| JP | 08-271167 | A | 10/1996 | |
| JP | 10-030890 | A | 2/1998 | |
| JP | 10-062033 | A | 3/1998 | |
| JP | 2000-346583 | A | 12/2000 | |
| JP | 2001-355994 | A | 12/2001 | |
| JP | 2003-185375 | A | 7/2003 | |
| JP | 2003-294382 | A | 10/2003 | |
| JP | 2005-083623 | A | 3/2005 | |
| JP | 2005-201495 | A | 7/2005 | |
| JP | 2011-007410 | A | 1/2011 | |

OTHER PUBLICATIONS

Office Action dated May 23, 2016 issued in corresponding CN patent application No. 201280076435.3 (and English translation).
Office Action dated Apr. 5, 2016 issued in corresponding JP patent application No. 2014-541853 (and English translation).
Office Action dated Aug. 25, 2015 issued in corresponding JP patent application No. 2014-541853 (and English translation).
International Search Report of the International Searching Authority dated Jan. 22, 2013 for the corresponding international application No. PCT/JP2012/076726 (and English translation).

* cited by examiner

Prior Art

Prior Art

PLATE TYPE HEAT EXCHANGER AND REFRIGERATION CYCLE APPARATUS HAVING THE SAME PLATE TYPE HEAT EXCHANGER

CROSS REFERENCE TO RELATED APPLICATION

This application is a U.S. national stage application of International Application No. PCT/JP2012/076726 filed on Oct. 16, 2012, the disclosure of which is incorporated by reference.

TECHNICAL FIELD

The present invention relates to a plate type heat exchanger and a refrigeration cycle apparatus having the same plate type heat exchanger.

BACKGROUND ART

Conventionally, plate type heat exchangers have been proposed in which a plurality of heat transfer plates are stacked between two side plates with predetermined intervals in between so that a first flow path through which a first fluid circulates and a second flow path through which a second fluid circulates are alternatively disposed in a space formed between the heat transfer plates. Further, for such conventional plate type heat exchangers, plate type heat exchangers have also been proposed in which inner fins are disposed in the flow paths in order to improve heat transfer performance, for example as described in the description "in the plate type heat exchanger in which a plurality of heat transfer plates 1, 1 . . . are stacked to form first flow paths 2, 2 . . . and second flow paths 3, 3 . . . each adjacent to the heat transfer plates 1, 1 and allow for heat exchange between the first fluid X and the second fluid Y which circulate in the first flow paths 2, 2 . . . and the second flow paths 3, 3 . . . , respectively, inner fins 4, 4 . . . that improve heat transfer and increase heat transfer surface area are disposed in the first flow paths 2, 2 . . . and the second flow paths 3, 3 . . . so that heat transfer between the heat transfer plates 1, 1 which form the flow paths 2, 3 is improved and the heat transfer surface area is also increased due to the interposed inner fins 4, 4 having high freedom of design." (See Patent Literature 1.)

Further, for the conventional plate type heat exchangers which include the inner fins disposed in the flow paths, plate type heat exchangers have been proposed, for example as described in the description "in the core section 1 of the oil cooler, the oil flow paths 7 and the cooling water flow paths 8 are alternatively formed between the core plates 5, 6 by alternatively stacking a plurality of first core plates 5 and second core plates 6 having the essentially same shape. The fin plates 11 are disposed in each of the oil flow paths 7. The first projections 31 and the second projections 32 are disposed on the first core plate 5 and the second core plate 6, respectively, so as to project outward from the oil flow path 7 and to be located alternatively with respect to the flow of oil." (See Patent Literature 2.)

Further, for the conventional heat exchangers which include the inner fins disposed in the flow paths, heat exchangers which include two heat transfer plates formed as one flat tube have also been proposed, for example as described in the description "a plurality of inclined grooves 7 for flowing condensate water are formed on the flat surface 1*a* of the flat tube 1 so as to be inclined to the longitudinal direction with the downstream end reaching a curved portion 1*b* of the tube, and the projection 7*a* is formed on the outer surface of the flat tube 1. Then, the inner fin 6 is inserted into the flat tube 1." (See Patent Literature 3.)

CITATION LIST

Patent Literature

Patent Literature 1: Japanese Unexamined Patent Application Publication No. 2003-185375 (abstract, FIG. 1)
Patent Literature 2: Japanese Unexamined Patent Application Publication No. 2011-007410 (abstract, FIG. 9)
Patent Literature 3: Japanese Unexamined Patent Application Publication No. 2003-294382 (abstract, FIG. 2)

SUMMARY OF INVENTION

Technical Problem

When the first fluid (such as refrigerant) is condensed from vapor to liquid in the flow path in which inner fin is provided, that is, the second refrigerant (such as water) which flows in the flow path adjacent to the flow path in which the first fluid flows is heated by the first fluid, the heat exchangers described in Patent Literatures 1 to 3 have problems as described below.

In the plate type heat exchanger described in Patent Literature 1, an area that faces (in contact with) the heat transfer surface of the heat transfer plate and the heat transfer surface of the inner fin is formed to be flat. As a result, in the flow path in which the first fluid flows, condensate liquid film tends to be formed in the area that faces (in contact with) the heat transfer surface of the heat transfer plate and the heat transfer surface of the inner fin. Consequently, there is a problem that heat transfer rate from the first fluid to the second fluid decreases due to heat resistance provided by the liquid film.

On the other hand, the projections (projections 31, 32) are formed on the heat transfer surface of the heat transfer plate in the plate type heat exchanger described in Patent Literature 2, and the inclined groove (inclined groove 7) is formed on the heat transfer surface of the flat tube of the heat exchanger described in Patent Literature 3. As a result, those heat exchangers can prevent the liquid film from being formed in the area that faces (in contact with) the heat transfer surface of the heat transfer plate and the heat transfer surface of the inner fin compared with the plate type heat exchanger described in Patent Literature 1. However, since the projections of the plate type heat exchanger described in Patent Literature 2 are formed to be vertical to the flow direction of the first fluid, drainage of the condensate liquid which is held in the projection is poor. As a result, the plate type heat exchanger described in Patent Literature 2 has a problem that heat transfer rate from the first fluid to the second fluid decreases due to heat resistance provided by the condensate liquid which is stagnated in the projection. Furthermore, the inclined groove of the heat exchanger described in Patent Literature 3 is inclined to the flow direction of the first fluid and is discontinuously formed. As a result, in the heat exchanger described in Patent Literature 3, the condensate liquid which is held in the inclined groove tends to be stagnated, and the stagnated condensate liquid becomes heat resistance. Consequently, similarly to the plate type heat exchanger described in Patent Literature 2, the heat exchanger described in Patent Literature 3 also has a problem that heat transfer rate from the first fluid to the second fluid decreases.

The present invention has been made to solve the problems described above, and the objective of the invention is to provide a plate type heat exchanger that is capable of preventing decrease of heat transfer rate due to forming of condensate liquid film and preventing decrease of heat transfer rate due to stagnation of the condensate liquid, and a refrigeration cycle apparatus having the same heat exchanger.

Solution to Problem

A plate type heat exchanger according to the present invention, in which a plurality of heat transfer plates having a flat heat transfer surface are aligned between two side plates with predetermined intervals in between, an inlet port and an outlet port for a first fluid and an inlet port and an outlet port for a second fluid different from the first fluid communicate with each other in an alternative manner in a space formed between the side plate and the heat transfer plate and between each of the heat transfer plates, so that a first flow path through which the first fluid circulates and a second flow path through which the second fluid circulates are alternatively formed, an inner fin is disposed at least in the first flow path in an area that faces the heat transfer surface, wherein, in an installation area of the inner fin in the first flow path, a plurality of recessed grooves having a dimension smaller than that between fin sections of the inner fin are formed along a flow direction of the first fluid in at least one of an area of the inner fin that faces the heat transfer plate and on the heat transfer plate.

Further, a refrigeration cycle apparatus according to the present invention includes the plate type heat exchanger according to the present invention.

In the present invention, when the first fluid (such as refrigerant) is condensed from vapor to liquid, for example, in the first flow path in which inner fin is provided, the condensate liquid film of the first fluid can be held in the recessed groove and the condensate liquid film of the first fluid can be collected in the recessed groove. Accordingly, the present invention can prevent the liquid film from being formed on the heat transfer surface of the heat transfer plate and in an area that faces (is in contact with) the heat transfer surface of the inner fin. Or alternatively, the present invention can reduce the thickness of the condensate liquid film of the first fluid formed on the heat transfer surface of the heat transfer plate and in an area of the inner fin that faces (is in contact with) the heat transfer surface. Accordingly, the present invention can improve heat transfer rate from the first fluid to the second fluid.

Further, in the present invention, the recessed groove is formed along the flow direction of the first fluid. Accordingly, the condensate liquid of the first fluid held in the recessed groove easily flows to the downstream side, which improves drainage of the condensate liquid of the first fluid from the recessed groove. Therefore, in the present invention, decrease in heat transfer rate from the first fluid to the second fluid due to the condensate liquid of the first fluid stagnated in the recessed groove can be prevented.

DESCRIPTION OF EMBODIMENTS

Embodiment 1

Figure 1:
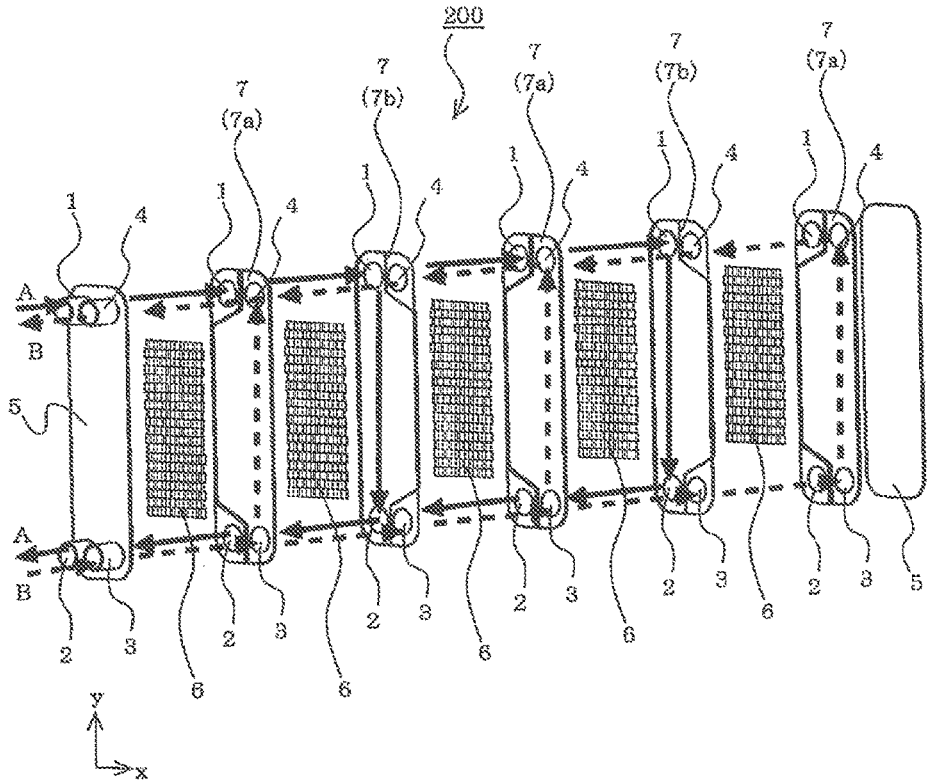
FIG. 1 is an exploded perspective view of a conventional plate type heat exchanger.

In a plate type heat exchanger 100 according to Embodiment 1, inner fins 6 are provided in flow paths. One of the characteristics of the plate type heat exchanger 100 according to Embodiment 1 is that recessed grooves 8 are formed in the inner fins 6 and recessed grooves 9 are formed in heat transfer plates 7.

In order to facilitate the understanding of the plate type heat exchanger 100 according to Embodiment 1, a general conventional plate type heat exchanger 200 (that is, a plate type heat exchanger in which the recessed grooves 8, 9 of Embodiment 1 are not formed) will be first described. Then, the plate type heat exchanger 100 according to Embodiment 1 will be described in comparison with the conventional plate type heat exchanger 200.

In the description of the plate type heat exchanger 100 according to Embodiment 1 and the conventional plate type heat exchanger 200, the same reference numerals refer to the configurations for performing the same functions.

Figure 2:
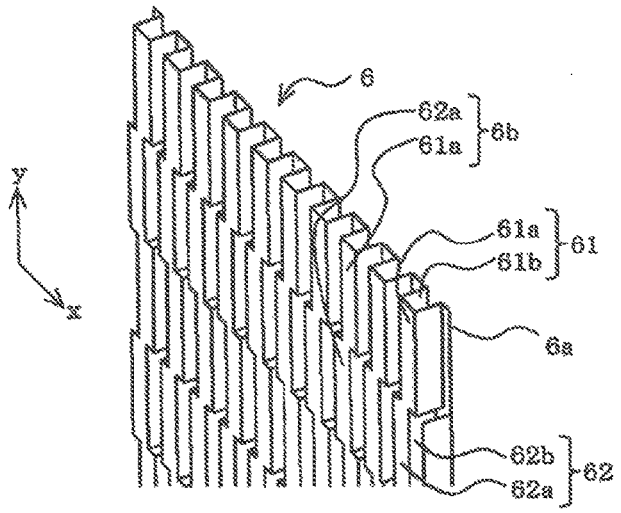
Prior Art FIG. 2
FIG. 2 is a perspective view of an inner fin which is provided in the conventional plate type heat exchanger.
Figure 3:
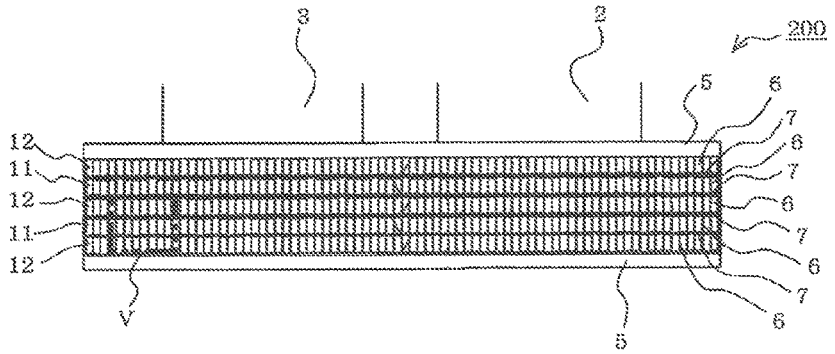
FIG. 3 is a sectional view of the conventional plate type heat exchanger.
Figure 4:
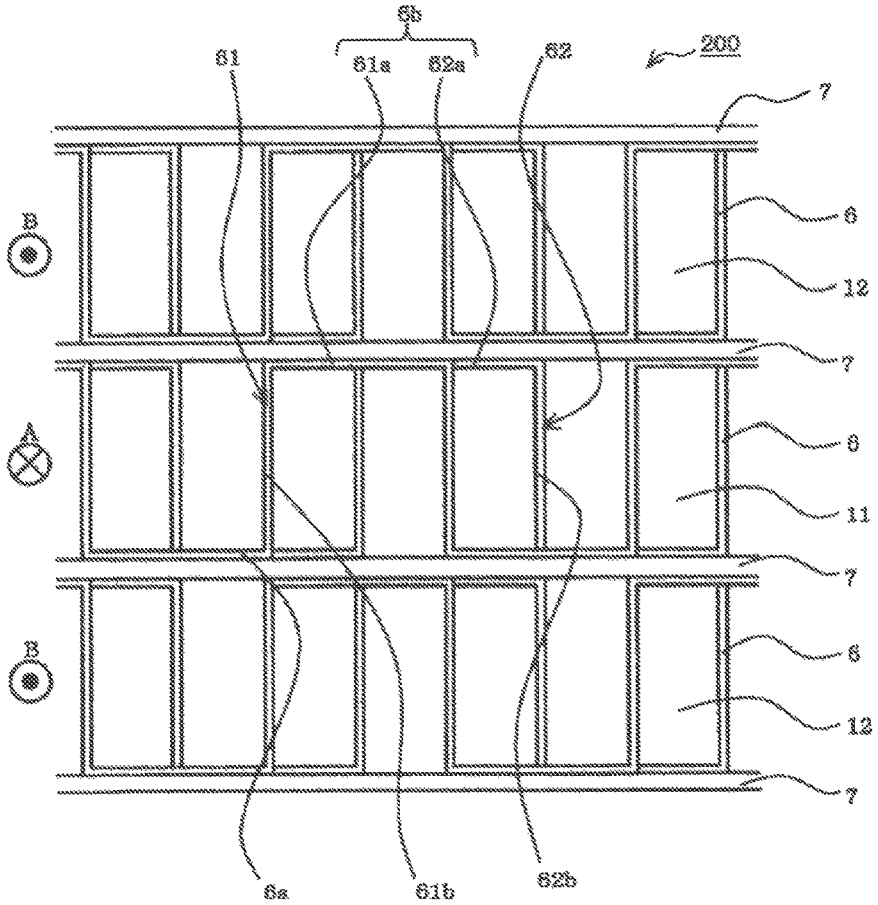
Prior Art FIG. 4
FIG. 4 is an enlarged view of a V section of FIG. 3.

FIG. 1 is an exploded perspective view of a conventional plate type heat exchanger. FIG. 2 is a perspective view of an inner fin which is provided in the plate type heat exchanger. FIG. 3 is a sectional view of the plate type heat exchanger. FIG. 4 is an enlarged view of a V section of FIG. 3. Furthermore, FIG. 3 is a sectional view which is taken in a cross section vertical to a flow direction of a fluid that flows in a flow path formed between the heat transfer plates. Furthermore, "A" in FIGS. 1 and 4 indicates a first fluid flow direction, while "B" in FIGS. 1 and 4 indicates a second fluid flow direction.

First, with reference to FIGS. 1 and 4, the conventional plate type heat exchanger 200 will be described.

The plate type heat exchanger 200 has a configuration in which, for example, a plurality of heat transfer plates 7 having a flat heat transfer surface are stacked between two side plates 5 for reinforcing the plate type heat exchanger 200 with predetermined intervals in between. The two side plates 5 are formed, for example, in a rectangular shape. Further, a first fluid inlet port 1, a first fluid outlet port 2, a second fluid inlet port 3 and a second fluid outlet port 4 are formed at four corners on each side plate 5. The first fluid inlet port 1, the first fluid outlet port 2, the second fluid inlet port 3 and the second fluid outlet port 4 are each connected to pipes.

In the following description, for convenience of explanation, a short hand direction of the side plate 5 is referred to as an x axis direction and a longitudinal direction of the side plate 5 is referred to as a y axis direction.

The heat transfer plates 7 are made up of two types of heat transfer plates (heat transfer plates 7*a* and heat transfer plates 7*b*). The heat transfer plates 7*a* and the heat transfer plates 7*b* are alternatively arranged between two side plates 5. The heat transfer plates 7*a* and the heat transfer plates 7*b* are formed in a rectangular shape similarly to the side plates 5 and have a flat heat transfer surface. Further, similarly to the side plates 5, the first fluid inlet port 1, the first fluid outlet port 2, the second fluid inlet port 3 and the second fluid outlet port 4 are formed at four corners on the heat transfer plates 7*a* and the heat transfer plates 7*b* (hereinafter, the heat transfer plate 7*a* and the heat transfer plate 7*b* are collectively referred to as a heat transfer plate 7).

The heat transfer plate 7*a* includes a peripheral section, the first fluid inlet port 1 and the first fluid outlet port 2 which protrude therefrom. That is, the heat transfer plate 7*a* has a configuration in which a flow path which communicates the second fluid inlet port 3 and the second fluid outlet port 4 is separated from the first fluid inlet port 1 and the first fluid outlet port 2. On the other hand, the heat transfer plate 7*b* includes a peripheral section, the second fluid inlet port 3 and the second fluid outlet port 4 which protrude therefrom. That is, the heat transfer plate 7*b* has a configuration in which a flow path which communicates the first fluid inlet port 1 and the first fluid outlet port 2 is separated from the second fluid inlet port 3 and the second fluid outlet port 4. Accordingly, in the state in which the side plates 5, the heat transfer plates 7*a* and the heat transfer plates 7*b* are assembled, first flow paths 11 through which the first fluid flows and second flow paths 12 through which the second fluid flows are alternatively formed. As shown in FIGS. 1 and 4, the first fluid that flows in the first flow path 11 flows from the upper side to the lower side of FIG. 1 along the y axis, while the second fluid that flows in the second flow path 12 flows from the lower side to the upper of FIG. 1 along the y axis. That is, the first fluid and the second fluid are opposite flows.

Further, in the first flow paths 11 and the second flow paths 12 of the plate type heat exchanger 200, the inner fins 6 are provided in an area that faces the heat transfer surfaces of the heat transfer plate 7. The inner fins 6 are made up of a plurality of first cut-and-raised portions 61 and a plurality of second cut-and-raised portions 62 which are cut and raised from a base plate 6*a*. Specifically, the first cut-and-raised portion 61 has a U-shaped cross section and is made up of a first top surface 61*a* which is parallel to the base plate 6*a* and two first legs 61*b* which connect each end of the first top surface 61*a* and the base plate 6*a*. The plurality of first cut-and-raised portions 61 are arranged in the x axis direction with predetermined intervals in between. Further, the second cut-and-raised portion 62 has a U-shaped cross section and is made up of a second top surface 62*a* which is parallel to the base plate 6*a* and two second legs 62*b* which connect each end of the second top surface 62*a* and the base plate 6*a*. Similarly to the first cut-and-raised portion 61, the plurality of second cut-and-raised portions 62 are arranged in the x axis direction with predetermined intervals in between.

The second cut-and-raised portions 62 are offset from the first cut-and-raised portions 61 in the x axis direction such that a portion of the second top surface 62*a* is connected to a portion of the first top surface 61*a* (hereinafter, the first top surface 61*a* and the second top surface 62*a* are collectively referred to as a top surface 6*b*). The plurality of first cut-and-raised portions 61 which are arranged in the x axis direction with predetermined intervals in between and the plurality of second cut-and-raised portions 61 which are arranged in the x axis direction with predetermined intervals in between are arranged in a plurality of rows in the y axis direction such that a portion of second top surface 62*a* is connected to a portion of first top surface 61*a*. In other words, the inner fin 6 has a configuration in which a plurality of first legs 61*b* and second legs 62*b* are formed between the base plates 6*a* and the top surfaces 6*b*.

The inner fins 6 having the above configuration are arranged in the first flow paths 11 and the second flow paths 12 such that the base plate 6*a* faces (is bonded to) one of the heat transfer plate 7*a* and the heat transfer plate 7*b* and the top surface 6*b* faces (is bonded to) the other of the heat transfer plate 7*a* and the heat transfer plate 7*b*. That is, the first legs 61*b* of the first cut-and-raised portion 61 and the second legs 62*b* of the second cut-and-raised portion 62 are provided as fin sections formed in the y axis direction in the first flow paths 11 and the second flow path 12. Accordingly, since the first fluid flowing in the first flow path 11 and the second fluid flowing in the second flow path 12 are stirred by the first legs 61*b* and the second legs 62*b*, heat exchange efficiency between the first fluid and the second fluid is improved.

However, the plate type heat exchanger 200 of such a configuration has the following problems.

In the plate type heat exchanger 200, during heat exchange between the first fluid and the second fluid, heat of the fluid of higher temperature is transferred to the fluid of lower temperature via the heat transfer surface of the heat transfer plates 7 and the base plates 6*a* and the top surfaces 6*b* of the inner fins 6. For example, when the first fluid such as high temperature refrigerant exchanges heat with the second fluid such as low temperature water, heat of the first fluid is transferred to the second fluid via the heat transfer surface of the heat transfer plates 7, the base plates 6*a* and the top surfaces 6*b* of the inner fins 6. Then, the first fluid in a vapor state is condensed in the first flow path 11 during the process of transferring heat to the second fluid. Since the heat transfer surface of the heat transfer plates 7 and the base plates 6*a* and the top surfaces 6*b* of the inner fins 6 of the plate type heat exchanger 200 are formed flat, liquid film of the condensate of the first fluid tends to be formed. Consequently, heat transfer rate from the first fluid to the second fluid decreases due to resistance provided by the liquid film.

In the plate type heat exchanger 100 according to Embodiment 1, as shown in FIGS. 5 to 8, the recessed grooves 8 of the inner fins 6 and the recessed grooves 9 of the heat transfer plates 7 are provided in addition to the configuration of the conventional plate type heat exchanger 200.

Figure 5:
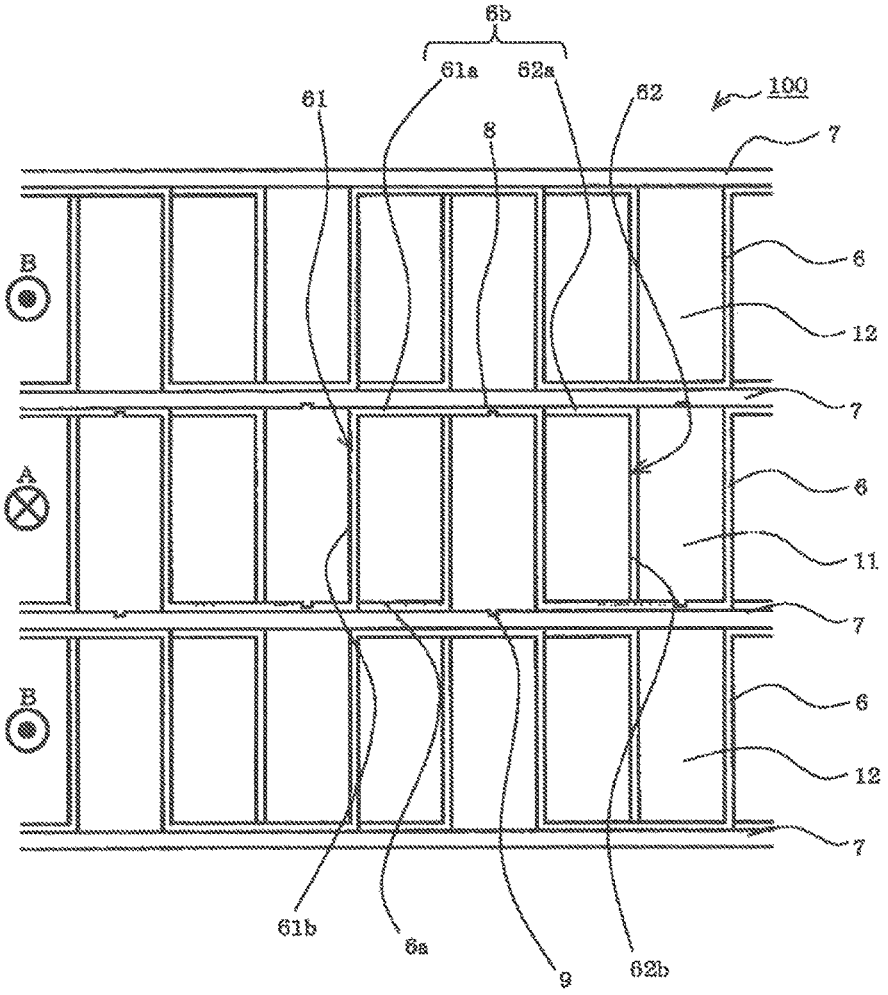
FIG. 5 is an enlarged view of an essential portion of a plate heat exchanger according to Embodiment 1 of the invention and an enlarged view of a position which corresponds to the V section of FIG. 3.
Figure 6:
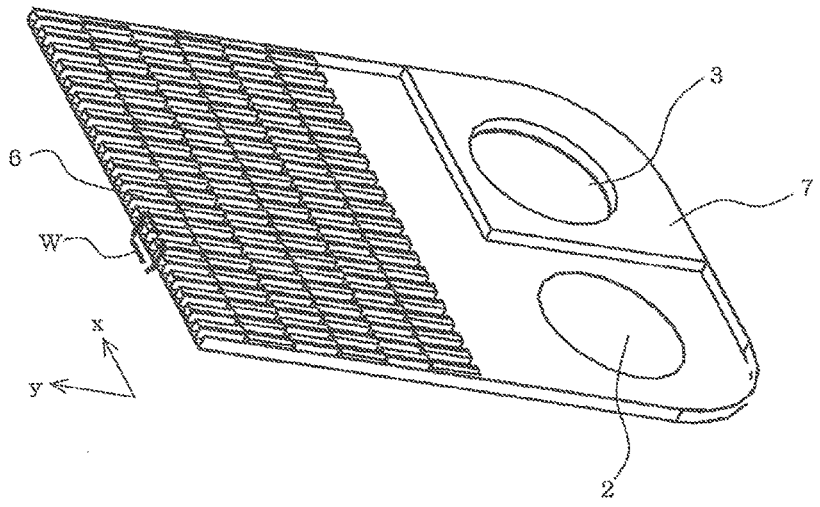
FIG. 6 is a perspective view of a heat transfer plate and an inner fin of the plate heat exchanger according to Embodiment 1 of the invention.
Figure 7:
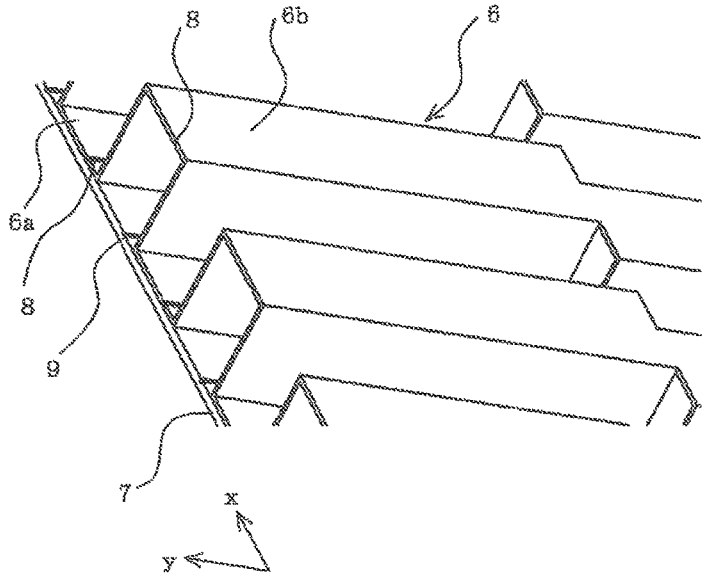
FIG. 7 is an enlarged view of a W section of FIG. 6.
Figure 8:
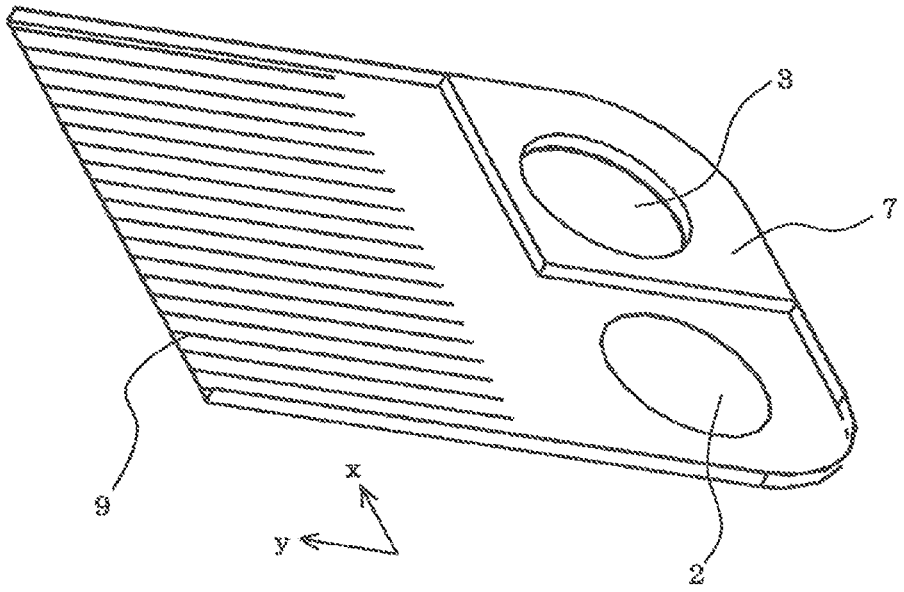
FIG. 8 is a perspective view of the heat transfer plate of the plate heat exchanger according to Embodiment 1 of the invention.

FIG. 5 is an enlarged view of an essential portion of a plate heat exchanger according to Embodiment 1 of the invention and an enlarged view of a position which corresponds to the V section of FIG. 3. FIG. 6 is a perspective view of a heat transfer plate and an inner fin of the plate heat exchanger according to Embodiment 1. FIG. 7 is an enlarged view of a W section of FIG. 6. FIG. 8 is a perspective view of the heat transfer plate of the plate heat exchanger according to Embodiment 1. Furthermore, "A" in FIG. 5 indicates the first fluid flow direction, while "B" in FIGS. 1 and 4 indicates the second fluid flow direction.

As shown in FIGS. 5 and 7, in the plate type heat exchanger 100 according to Embodiment 1, a plurality of recessed grooves 8 having a U-shaped cross section is disposed on the inner fin 6 which is provided in the first flow path 11. The recessed grooves 8 are formed in the y axis, that is, in the first fluid flow direction. Further, the recessed grooves 8 are formed on a surface of the base plates 6*a* of the first flow path side and on a surface of the top surfaces 6*b* on the first flow path side. That is, those recessed grooves 8 are disposed in an area of the inner fin 6 that faces (in contact with) the heat transfer surface of the heat transfer plate 7. Further, in Embodiment 1, the recessed grooves 8 are continuously formed from upstream to downstream of the flow direction of the first fluid which flows in the inner fin 6. In Embodiment 1, the recessed grooves 8 are each formed in a straight shape.

As shown in FIGS. 5 and 8, a plurality of recessed grooves 9 having a U-shaped cross section is disposed on the heat transfer surface of the heat transfer plate 7 of the plate type heat exchanger 100 according to Embodiment 1 in an area that does not face (not in contact with) the base plates 6*a* and the top surfaces 6*b* of the inner fins 6 in the first flow path 11. The recessed grooves 9 are formed in the y axis, that is, in the first fluid flow direction. Further, in Embodiment 1, each of the recessed grooves 9 are continuously formed from upstream to downstream of the flow direction of the first fluid which flows in the inner fin 6. In Embodiment 1, the recessed grooves 9 are each formed in a straight shape.

That is, the recessed grooves 8 of the inner fin 6 and the recessed grooves 9 of the of the heat transfer plate 7 are formed in an area that is in contact with the first fluid.

In the plate type heat exchanger 100 having the above configuration according to Embodiment 1, for example, when the first fluid such as refrigerant of high temperature in a vapor state is condensed in the first flow path 11 during a process of transferring heat to the second fluid, the condensate liquid film of the first fluid can be held in the recessed grooves 8 and the recessed grooves 9 and the condensate liquid film of the first fluid can be collected in the recessed grooves 8 and the recessed grooves 9. Accordingly, in the plate type heat exchanger 100 according to Embodiment 1, the condensate liquid film of the first fluid can be prevented from being formed on the heat transfer surface of the heat transfer plates 7, the base plates 6*a* and the top surfaces 6*b* of the inner fins 6 in the first flow paths 11. Furthermore, in the plate type heat exchanger 100 according to Embodiment 1, the thickness of the condensate liquid film of the first fluid formed on the heat transfer surface of the heat transfer plates 7, the base plates 6*a* and the top surfaces 6*b* of the inner fins 6 in the first flow paths 11 can be decreased. Accordingly, in the plate type heat exchanger 100 according to Embodiment 1, heat transfer rate from the first fluid to the second fluid can be improved.

Furthermore, in the plate type heat exchanger 100 according to Embodiment 1, the recessed grooves 8 and the recessed grooves 9 are formed in the first fluid flow direction. Accordingly, the condensate liquid of the first fluid held in the recessed grooves 8 and the recessed grooves 9 easily flows to the downstream side, which improves drainage of the condensate liquid of the first fluid from the recessed grooves 8 and the recessed grooves 9. Therefore, in the plate type heat exchanger 100 according to Embodiment 1, decrease in heat transfer rate from the first fluid to the second fluid due to the condensate liquid of the first fluid stagnated in the recessed grooves 8 and the recessed grooves 9 can also be prevented.

Furthermore, in the plate type heat exchanger 100 according to Embodiment 1, the recessed grooves 8 and the recessed grooves 9 are continuously formed from upstream to downstream of the flow direction of the first fluid which flows in the inner fin 6. Accordingly, drainage of the condensate liquid of the first fluid from the recessed grooves 8 and the recessed grooves 9 is further improved, thereby further improving heat transfer rate from the first fluid to the second fluid.

Furthermore, in the plate type heat exchanger 100 according to Embodiment 1, since the recessed grooves 8 and the recessed grooves 9 are formed in a straight shape, drainage of the condensate liquid of the first fluid from the recessed grooves 8 and the recessed grooves 9 is further improved, thereby further improving heat transfer rate from the first fluid to the second fluid.

Furthermore, in the plate type heat exchanger 100 according to Embodiment 1, the recessed groove 9 is smaller than the thickness of the heat transfer plate 7. As a result, the recessed grooves 9 can be formed on the heat transfer plate 7 without the heat transfer surface of the heat transfer plate 7 protruding to the second flow path 12. Accordingly, manufacturing of the plate type heat exchanger 100 can be facilitated since complicated bonding of the heat transfer plate 7 and the inner fin 6 is not necessary.

Embodiment 1 has been described with an example of the first fluid of high temperature which heats the second fluid while the first fluid is condensed (changes in phase). However, also in the case where the first fluid of low temperature cools the second fluid of high temperature while the first fluid is evaporated, and in the case where the first fluid exchanges heat with the second fluid while remaining in the same phase (liquid phase or gas phase), the plate type heat exchanger 100 according to Embodiment 1 has the effect of improving heat transfer rate between the first fluid and the second fluid. It is because nuclear boiling can be facilitated by holding the first fluid in the recessed grooves 8 and the recessed grooves 9 during evaporation of the first fluid, thereby improving heat transfer rate between the first fluid and the second fluid. Further, it is because stirring effect of the first fluid is improved by corners of the recessed groove 8 (the boundary between the flat portion of the base plate 6*a* and the top surface 6*b* of the inner fin 6 and the recessed groove 8) and corners of the recessed groove 9 (the boundary between the flat portion of the heat transfer surface of the heat transfer plate 7 and the recessed groove 9) in the case where the first fluid exchanges heat with the second fluid while remaining in the same phase (liquid phase or gas phase). This stirring effect can also be obtained when the first fluid is condensed or evaporated.

Embodiment 2

The recessed groove 8 and the recessed groove 9 shown in Embodiment 1 have a substantially U-shape with a constant distance from the opening to the bottom in the cross section which is vertical to the longitudinal direction of those recessed grooves. The cross sectional shape of the recessed groove 8 and the recessed groove 9 is not limited thereto, and for example, may be formed in the following shapes. A configuration which is not specifically described in Embodiment 2 is the same as that of Embodiment 1, and the same function and configuration are denoted by the same reference numbers.

Figure 9:
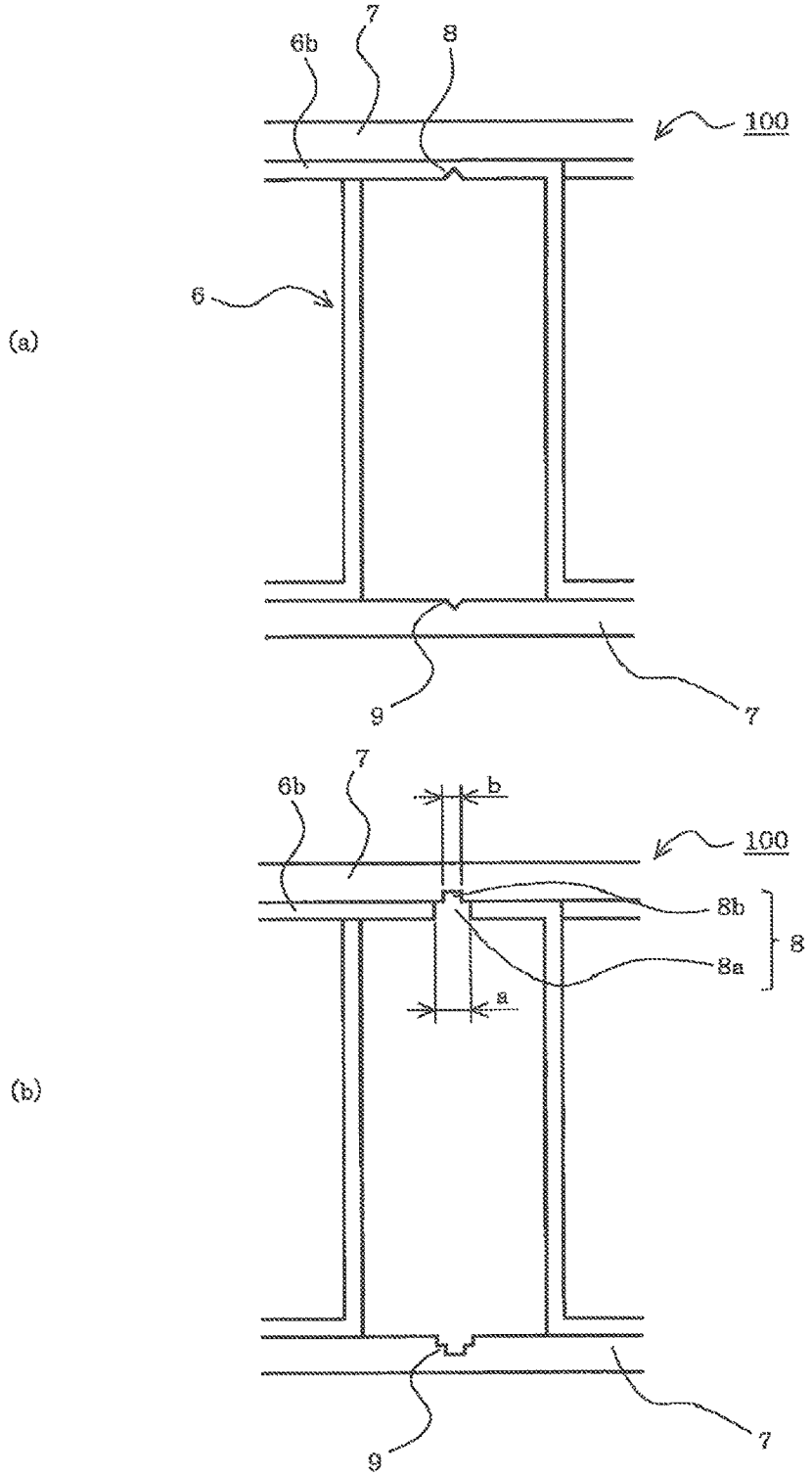
FIG. 9 is an enlarged view of an essential portion of one example of the plate type heat exchanger according to Embodiment 2 of the invention.

FIG. 9 is an enlarged view of an essential portion of one example of the plate type heat exchanger according to Embodiment 2 of the invention. FIG. 9 is a sectional view which is taken in a cross section vertical to the longitudinal direction of the recessed groove 8 and the recessed groove 9.

In the cross section vertical to the longitudinal direction of the recessed groove 8 and the recessed groove 9, the recessed groove 8 and the recessed groove 9 of the plate type heat exchanger 100 according to Embodiment 2 are formed to have a width decreasing from the opening to the bottom. For example, as shown in FIG. 9 (*a*), the recessed groove 8 and the recessed groove 9 having the width decreasing from the opening to the bottom can be formed by providing the recessed groove 8 and the recessed groove 9 with a triangle cross section. Further, for example, as shown in FIG. 9 (*b*), the recessed groove 8 and the recessed groove 9 having the width decreasing from the opening to the bottom can be formed by providing the recessed groove 8 and the recessed groove 9 with a stair-shaped side surface, in other words, by forming a recessed groove on the bottom of the recessed groove 8 and the recessed groove 9 having a width smaller than that of the recessed groove.

In FIG. 9 (*b*), the recessed groove 8 is made up of a through groove 8*a* having a square-shaped cross section formed on the base plate 6*a* and the top surface 6*b* of the inner fin 6 and a bottom side recessed groove 8*b* having the width smaller than that of the through groove 8*a* formed at a position which faces the through groove 8*a* of the heat transfer plate 7. As a matter of course, the recessed groove 8 is not limited thereto, and may be formed by disposing a recessed groove on the bottom of the recessed groove formed on the base plate 6*a* and the top surface 6*b* of the inner fin 6 so as to have the width smaller than that of the recessed groove. That is, the recessed groove 8 may be formed only by processing the base plate 6*a* and the top surface 6*b* of the inner fin 6. In other words, the recessed groove 8 shown in FIG. 9 (*a*) may be made up of the through groove 8*a* having a trapezoid-shaped cross section formed on the inner fin 6 and the bottom side recessed groove 8*b* having a triangular cross section formed at a position which faces the through groove 8*a* of the heat transfer plate 7. Further, as a matter of course, the recessed groove 8 shown in Embodiment 1 may be made up of the through groove 8*a* having a square-shaped cross section formed on the inner fin 6 and the bottom side recessed groove 8*b* having the same width as that of the through groove 8*a* formed at a position which faces the through groove 8*a* of the heat transfer plate 7.

The plate type heat exchanger 100 having the configuration according to Embodiment 2 can obtain the following effect compared with Embodiment 1, in addition to the same effect as Embodiment 1.

In the plate type heat exchanger 100 according to Embodiment 2, the amount of the condensate liquid held in the recessed groove 8 and the recessed groove 9 can be adjusted since the recessed groove 8 and the recessed groove 9 have the width which decreases from the opening to the bottom. For example, in the case where the first fluid is condensed in the first flow path 11, the plate type heat exchanger 100 according to Embodiment 2 can reduce the holding amount of the condensate liquid compared with the case of Embodiment 1 in an initial phase in which the condensate liquid film of the first fluid is formed. Then, the amount of condensate liquid held in the recessed groove 8 and the recessed groove 9 gradually increases as the first fluid is condensed, and the increase amount can be larger than that of Embodiment 1.

In Embodiment 2, since the recessed groove 8 is made up of the through groove 8*a* of the inner fin 6 and the bottom side recessed groove 8*b* of the heat transfer plate 7, the through groove 8*a* and the bottom side recessed groove 8*b* serve as a mark for aligning the inner fin 6 and the heat transfer plate 7. Accordingly, an assembly precision of the plate type heat exchanger 100 can be improved, thereby improving the reliability of the plate type heat exchanger 100.

In the case where the recessed groove 8 and the recessed groove 9 have a triangular cross section as shown in FIG. 9 (*a*), the holding amount of the liquid film during condensation can be adjusted by varying the apex angle or length of the triangle. Further, in the case where the recessed groove 8 and the recessed groove 9 are formed as shown in FIG. 9 (*b*), the holding amount of the liquid film during condensation can be adjusted by varying the dimensions a and b.

Embodiment 3

The shape of the recessed groove 8 and the recessed groove 9 is not limited to the shapes shown in Embodiment 1 and Embodiment 2, and may be, for example, the following cross sectional shape. A configuration which is not specifically described in Embodiment 3 is the same as that of Embodiment 1 or Embodiment 2, and the same function and configuration are denoted by the same reference numbers.

Figure 10:
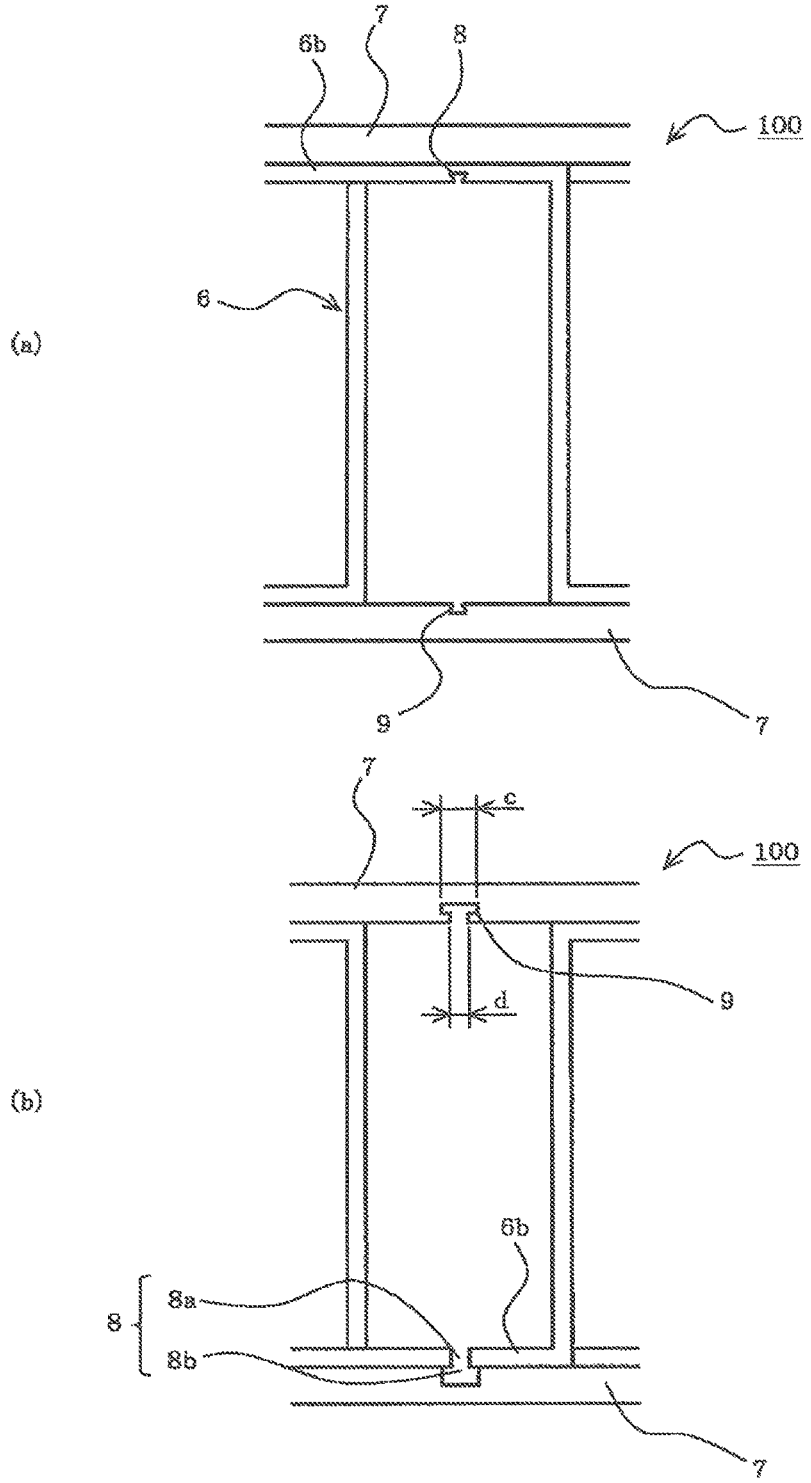
FIG. 10 is an enlarged view of an essential portion of one example of the plate type heat exchanger according to Embodiment 3 of the invention.

FIG. 10 is an enlarged view of an essential portion of one example of the plate type heat exchanger according to Embodiment 3 of the invention. FIG. 10 is a sectional view which is taken in a cross section vertical to the longitudinal direction of the recessed groove 8 and the recessed groove 9.

In the cross section vertical to the longitudinal direction of the recessed groove 8 and the recessed groove 9, the recessed groove 8 and the recessed groove 9 of the plate type heat exchanger 100 according to Embodiment 3 are formed to have a width increasing from the opening to the bottom. For example, as shown in FIG. 10 (*a*), the recessed groove 8 and the recessed groove 9 having the width increasing from the opening to the bottom can be formed by providing the recessed groove 8 and the recessed groove 9 with a trapezoidal cross section having the opening on the short side. Further, for example, as shown in FIG. 10 (*b*), the recessed groove 8 and the recessed groove 9 having the width increasing from the opening to the bottom can be formed by providing the recessed groove 8 and the recessed groove 9 with a stair-shaped side surface, in other words, by forming a recessed groove on the bottom of the recessed groove having a width larger than that of the recessed groove.

In FIG. 10 (*b*), the recessed groove 8 is made up of a through groove 8*a* having a square-shaped cross section formed on the base plate 6*a* and the top surface 6*b* of the inner fin 6 and a bottom side recessed groove 8*b* having the width larger than that of the through groove 8*a* formed at a position which faces the through groove 8*a* of the heat transfer plate 7.

The plate type heat exchanger 100 having the configuration according to Embodiment 3 can obtain the following effect compared with Embodiment 1, in addition to the same effect as Embodiment 1.

In the plate type heat exchanger 100 according to Embodiment 3, the amount of the condensate liquid held in the recessed groove 8 and the recessed groove 9 can be adjusted since the recessed groove 8 and the recessed groove 9 have the width which increases from the opening to the bottom. For example, in the case where the first fluid is condensed in the first flow path 11, the plate type heat exchanger 100 according to Embodiment 3 can increase the holding amount of the condensate liquid compared with the case of Embodiment 1 in an initial phase in which the condensate liquid film of the first fluid is formed. Then, the amount of condensate liquid held in the recessed groove 8 and the recessed groove 9 gradually increases as the first fluid is condensed, and the increase amount can be smaller than that of Embodiment 1.

Further, the recessed groove 8 and the recessed groove 9 according to Embodiment 3 have a shape which facilitates drawing of the condensate liquid. As a result, adjacent air bubbles in the recessed groove 8 and the recessed groove 9 tends to activate boiling, and accordingly, when the plate type heat exchanger 100 according to Embodiment 3 is used under the condition in which the fluid is evaporated, heat transfer rate between the first fluid and the second fluid can be improved compared with the case of Embodiment 1 and Embodiment 2.

Embodiment 4

An outlet port side recessed groove 9*a* and an inlet port side recessed groove 9*b* may be disposed at the end of the recessed groove 9 shown in Embodiments 1 to 3. A configuration which is not specifically described in Embodiment 4 is the same as that of any of Embodiments 1 to 3, and the same function and configuration are denoted by the same reference numbers.

Figure 11:
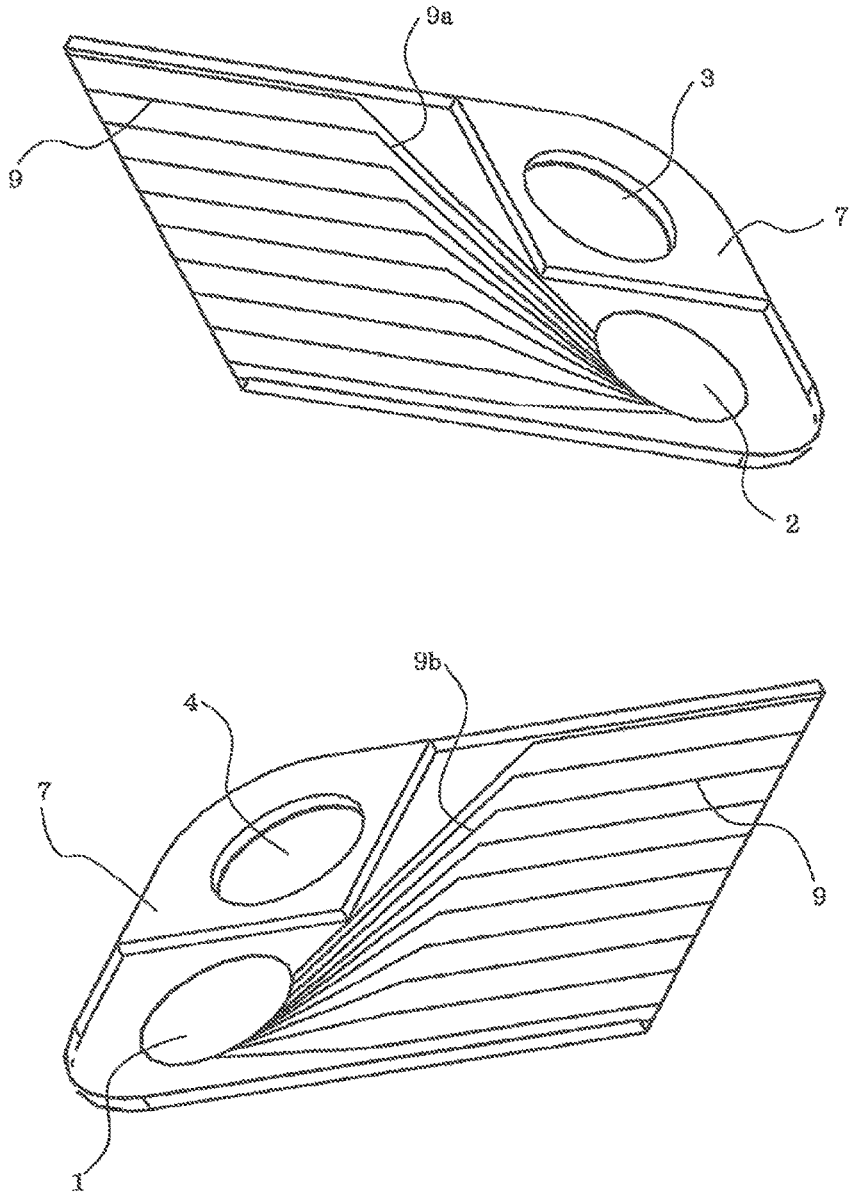
FIG. 11 is a perspective view of the heat transfer plate of the plate heat exchanger according to Embodiment 4 of the invention.

FIG. 11 is a perspective view of the heat transfer plate of the plate heat exchanger according to Embodiment 4 of the invention.

The outlet port side recessed groove 9*a* having one end connected to the recessed groove 9 and the other end connected to the outlet port 2 of the first fluid is formed on the heat transfer plate 7 of the plate type heat exchanger 100 according to Embodiment 4.

Further, the inlet port side recessed groove 9*b* having one end connected to the recessed groove 9 and the other end connected to the inlet port 1 of the first fluid is also formed on the heat transfer plate 7 of the plate type heat exchanger 100 according to Embodiment 4.

The flow of first fluid is inclined into the first fluid outlet port 2 after it flowed in the inner fin 6. Further, the flow of first fluid which flowed from the first fluid inlet port 1 to the first flow path 11 is inclined into the inner fin 6 after it flowed in inner fin 6. Accordingly, the flow path from the first fluid inlet port 1 to the inner fin 6 and the flow path from the inner fin 6 to the first fluid outlet port 2 are provided as flow paths which allows non-smooth flow compared with the flow path in the inner fin 6. However, since the plate type heat exchanger 100 according to Embodiment 4 has the inlet port side recessed groove 9*b* and the outlet port side recessed groove 9*a*, smooth flow of the first fluid can be achieved in the flow path which allows non-smooth flow compared with the flow path in the inner fin 6 by allowing the first fluid to flow along the inlet port side recessed groove 9*b* and the outlet port side recessed groove 9*a*. Since the first fluid is allowed to smoothly flow in the flow path which allows non-smooth flow compared with the flow path in the inner fin 6, the effective heat transfer surface area of the heat transfer plate 7 can be increased. These effect can be obtained only by providing either of the inlet port side recessed groove 9*b* or the outlet port side recessed groove 9*a* for the first fluid.

The present invention has been described in the above Embodiments 1 to 4 by an example of the plate type heat exchanger 100 in which the inner fins 6 are disposed in the second flow path 12. However, as a matter of course, the present invention can be applied to the plate type heat exchanger in which the inner fins 6 are not disposed in the second flow path 12 and the inner fins 6 are disposed only in the first flow path 11.

Further, in the above Embodiments 1 to 4, the present invention has been described by an example of the plate type heat exchanger 100 in which the recessed groove 8, the recessed groove 9, the outlet port side recessed groove 9*a* and the inlet port side recessed groove 9*b* are disposed only in the first flow path 11. However, the recessed groove 8, the recessed groove 9, the outlet port side recessed groove 9*a* and the inlet port side recessed groove 9*b* may be formed in the second flow path 12. The effect same as that obtained in the first flow path 11 can also be obtained in the second flow path 12.

Further, in the above Embodiments 1 to 4, the present invention has been described by an example of the plate type heat exchanger 100 in which both the recessed groove 8 and the recessed groove 9 are formed. However, the effect same as that obtained above can also be obtained in the plate type heat exchanger 100 in which only one of the recessed groove 8 and the recessed groove 9 is formed.

Further, in the above Embodiments 1 to 4, the present invention has been described by an example of the plate type heat exchanger 100 in which the first flow path and the second flow path are provided as opposing flows. However, as a matter of course, the first flow path and the second flow path may be provided as parallel flows.

Further, as a matter of course, the plate type heat exchanger according to the present invention may be formed by combining the recessed groove 8 and the recessed groove 9 which are shown in Embodiments 1 to 3.

Embodiment 5

Finally, an example of a refrigeration cycle apparatus having the plate type heat exchanger 100 shown in Embodiments 1 to 4.

Figure 12:
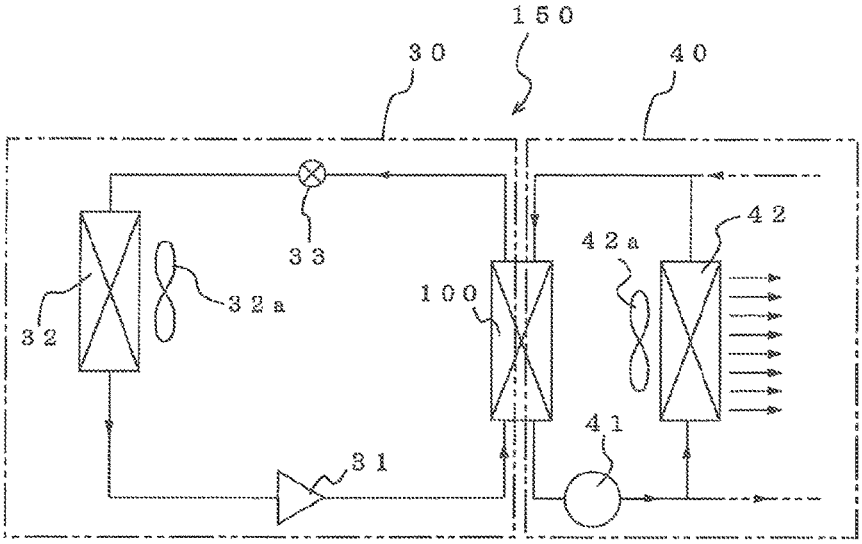
FIG. 12 is a circuit diagram of a refrigeration cycle apparatus according to Embodiment 5 of the invention.

FIG. 12 is a circuit diagram of a refrigeration cycle apparatus according to Embodiment 5 of the invention.

The refrigeration cycle apparatus 150 shown in FIG. 12 is an air conditioning apparatus which uses the plate type heat exchanger 100 described in any of Embodiments 1 to 4 as a refrigerant-to-refrigerant heat exchanger. The refrigeration cycle apparatus 150 is composed of a heat source side refrigerant circuit 30, a use side refrigerant circuit 40 and the like.

The heat source side refrigerant circuit 30 includes a compressor 31, the plate type heat exchanger 100 which serves as a condenser, an expansion valve 33, and an evaporator 32, which are connected by a refrigerant pipe in sequence. Further, the use side refrigerant circuit 40 includes a pump 41, a use side heat exchanger 42 and the plate type heat exchanger 100, which are connected by a refrigerant pipe in sequence.

A heat source side refrigerant (for example, the first fluid) which is in a vapor state compressed by the compressor 31 flows into the plate type heat exchanger 100. The heat source side refrigerant which has flowed into the plate type heat exchanger 100 heats and condenses a use side refrigerant (for example, the second fluid). The heat source side refrigerant condensed by the plate type heat exchanger 100 becomes a liquid refrigerant of a subcooling state and flows into the expansion valve 33. The heat source side refrigerant of low temperature and low pressure which is expanded by the expansion valve 33 becomes a two-phase state of low quality and flows into the evaporator 32. The heat source side refrigerant which has flowed into the evaporator 32 absorbs heat from the air sent out from the air sending device 32*a* and is evaporated. The heat source side refrigerant which is evaporated by the evaporator 32 is suctioned into the compressor 31 and is again compressed.

On the other hand, the use side refrigerant which is heated by heat exchange with the heat source side refrigerant by the plate type heat exchanger 100 is suctioned by the pump 41 and is then ejected, and flows into the use side heat exchanger 42. In the use side heat exchanger 42, the use side refrigerant heats the air in an air conditioning space which is sent out from the air sending device 42*a* so as to heat the air conditioning space. After that, the use side refrigerant again flows into the plate type heat exchanger 100.

Since the refrigeration cycle apparatus 150 having the above configuration is provided with the plate type heat exchanger 100 shown in Embodiments 1 to 4, the refrigeration cycle apparatus can provide high energy saving property and high reliability.

Although the refrigeration cycle apparatus 150 of Embodiment 5 uses the plate type heat exchanger 100 as a condenser for the heat source side refrigerant circuit 30, the plate type heat exchanger 100 may be used as an evaporator for the heat source side refrigerant circuit 30. As a matter of course, the plate type heat exchanger 100 may be used as both a condenser and an evaporator for the heat source side refrigerant circuit 30.

INDUSTRIAL APPLICABILITY

The plate type heat exchanger according to the present invention may be applied to various industrial and household appliances which use the plate type heat exchanger, for example, power generation machines and heat sterilization machines in addition to the above described air conditioning apparatus.

REFERENCE SIGNS LIST

1 first fluid inlet port 2 first fluid outlet port 3 second fluid inlet port 4 second fluid outlet port 5 side plate 6 inner fin 6*a* base plate 6*b* top surface 61 first cut-and-raised portion 61*a* first top surface 61*b* first leg 62 second cut-and-raised portion 62*a* second top surface 62*b* second leg 7 heat transfer plate 7*a* heat transfer plate 7*b* heat transfer plate 8 recessed groove 8*a* through groove 8*b* bottom side recessed groove 9 recessed groove 9*a* outlet port side recessed groove 9*b* inlet port side recessed groove 11 first flow path 12 second flow path 30 heat source side refrigerant circuit 31 compressor 32 evaporator 32*a* air sending device 33 expansion valve 40 use side refrigerant circuit 41 pump 42 use side heat exchanger 100 plate type heat exchanger 150 refrigeration cycle apparatus 200 (conventional) plate type heat exchanger A first fluid flow direction B second fluid flow direction

The invention claimed is:

1. A plate type heat exchanger comprising:

a plurality of heat transfer plates are stacked between two side plates with predetermined intervals in between;

a first fluid inlet port fluidly connected to a first fluid outlet port through which a first fluid circulates and a second fluid inlet port fluidly connected to a second fluid outlet port through which a second fluid different from the first fluid circulates respectively communicate with each other in an alternative manner through a space formed between the two side plates and the plurality of heat transfer plates and between each of the plurality of heat transfer plates;

a first flow path through which the first fluid circulates and a second flow path through which the second fluid circulates are formed alternatively with each other; and a corrugated inner fin is arranged within at least the first flow path in an area that faces a heat transfer surface of a first heat transfer plate of the plurality heat transfer plates, wherein the corrugated inner fin includes offset corrugations, each of the offset corrugations include a contact side having a first smooth surface contacted with the first heat transfer plate and a non-contact side having a second smooth surface that faces the first flow path on an opposite side of the contact side, and a first through groove is formed along a flow direction of the first fluid on the contact side of the corrugated inner fin, a second through groove is formed along a flow direction of the first fluid on the non-contact side of the corrugated inner fin, and a bottom-side groove is formed along a flow direction of the first fluid on the first heat transfer plate directly across from the first through groove of the corrugated inner fin to define a recessed groove between the bottom-side groove of the first heat transfer plate and the first through groove of the corrugated inner fin.

2. The plate type heat exchanger of claim 1, wherein the recessed groove has a width which decreases from an opening to a bottom in a cross section vertical to a longitudinal direction of the recessed groove.

3. The plate type heat exchanger of claim 1, wherein the recessed groove has a width which increases from an opening to a bottom in a cross section vertical to a longitudinal direction of the recessed groove.

4. The plate type heat exchanger of claim 1, wherein the corrugated inner fin is further disposed in an area that faces the heat transfer surface in the second flow path, and a second-flow-path recessed groove is formed along a flow direction of the second fluid.

5. The plate type heat exchanger of claim 1 wherein the recessed groove is each continuously formed from upstream to downstream in the flow direction of the fluid which flows in the corrugated inner fin.

6. The plate type heat exchanger of claim 1, wherein the first through groove or the second through groove is formed in a straight shape.

7. A refrigeration cycle apparatus comprising:

a plate type heat exchanger in which a plurality of heat transfer plates are stacked between two side plates with predetermined intervals in between;

a first fluid inlet port fluidly connected to a first fluid outlet port through which a first fluid circulates and a second fluid inlet port fluidly connected to a second fluid outlet port through which a second fluid different from the first fluid circulates respectively communicate with each other in an alternative manner through a space formed between the two side plates and the plurality of heat transfer plates and between each of the plurality of heat transfer plates;

a first flow path through which the first fluid circulates and a second flow path through which the second fluid circulates are formed alternatively with each other, and a corrugated inner fin is arranged within at least the first flow path in an area that faces a heat transfer surface of a first heat transfer plate of the plurality heat transfer plates, wherein the corrugated inner fin includes offset corrugations, each of the offset corrugations include a contact side having a first smooth surface contacted with the first heat transfer plate and a non-contact side having a second smooth surface that faces the first flow path on an opposite side of the contact side, and a first through groove is formed along a flow direction of the first fluid on the contact side of the corrugated inner fin, a second through groove is formed along a flow direction of the first fluid on the non-contact side of the corrugated inner fin, and a bottom-side groove is formed along a flow direction of the first fluid on the first heat transfer plate directly across from the first through groove of the corrugated inner fin to define a recessed groove between the bottom-side groove of the first heat transfer plate and the first through groove of the corrugated inner fin.

8. A plate type heat exchanger comprising:

a plurality of heat transfer plates are stacked between two side plates with predetermined intervals in between;

a first fluid inlet port fluidly connected to a first fluid outlet port through which a first fluid circulates and a second fluid inlet port fluidly connected to a second fluid outlet port through which a second fluid different from the first fluid circulates respectively communicate with each other in an alternative manner through a space formed between the two side plates and the plurality of heat transfer plates and between each of the plurality of heat transfer plates;

a first flow path through which the first fluid circulates and a second flow path through which the second fluid circulates are formed alternatively with each other;

a corrugated inner fin arranged within at least the first flow path in an area that faces a heat transfer surface on a first heat transfer plate of the plurality of heat transfer plates;

the corrugated inner fin includes offset corrugations, each of the offset corrugations includes a contact side having a first smooth surface contacted with the first heat transfer plate and a non-contact side having a second smooth surface that faces the first flow path on an opposite side of the contact side, a through groove having a depth smaller than a thickness of the first heat transfer plate and formed along a flow direction of the first fluid on the heat transfer plate is formed in an installation area of the contact side of the corrugated inner fin in the first flow path; and a bottom recessed groove formed in a portion of the first heat transfer plate that faces the through groove in the installation area of the contact side of the corrugated inner fin.

9. The plate type heat exchanger of claim 8, wherein at least one of an inlet port side recessed groove having one end connected to the recessed groove and the other end connected to an inlet port which communicates with the first flow path and an outlet port side recessed groove having one end connected to the recessed groove and the other end connected to an outlet port which communicates with the first flow path is formed in the flow path in which the recessed groove is formed.

10. The plate type heat exchanger of claim 8, wherein a depth of the recessed groove formed on the heat transfer plate is smaller than a thickness of the heat transfer plate.

* * * * *